United States Patent [19]

Kuno et al.

[11] 4,378,581

[45] Mar. 29, 1983

[54] DEMAGNETIZING APPARATUS FOR USE IN VEHICLES

[75] Inventors: Akira Kuno, Oobu; Muneaki Matsumoto, Okazaki; Koji Numata, Toyokawa, all of Japan

[73] Assignee: Nippon Soken, Inc., Nishio, Japan

[21] Appl. No.: 267,425

[22] Filed: May 26, 1981

[30] Foreign Application Priority Data

May 28, 1980 [JP] Japan ..... 55-71947

[51] Int. Cl.[3] ..... H01F 13/00

[52] U.S. Cl. ..... 361/149

[58] Field of Search ..... 361/149, 267

[56] References Cited

U.S. PATENT DOCUMENTS 3,110,282 11/1963 Foerster ..... 361/149

FOREIGN PATENT DOCUMENTS 619212 3/1949 United Kingdom ..... 361/149

OTHER PUBLICATIONS

"Combating Magnetic Mines", *Electrical Review*, Sep. 21, 1945, p. 412.

*Primary Examiner*—G. Z. Rubinson
*Assistant Examiner*—L. Schroeder
*Attorney, Agent, or Firm*—Cushman, Darby & Cushman

[57] ABSTRACT

A demagnetizing apparatus for removing residual magnetism in the body of an automobile which is equipped with a magnetic bearing indicator. A first and a second coil are wound around a substantially flat frame of a non-magnetic material to produce respectively a fixed d.c. magnetic field and a controllable a.c. magnetic field in orthogonal directions with each other and along flat surfaces of the substantially flat frame. The substantially flat frame with coils is positioned adjacent to but spaced from a body portion such as a roof, door or floor of the automobile, so that the d.c. magnetic field produced by the first coil cancel the external magnetic field caused by the terrestrial magnetism. The a.c. magnetic field is controlled to be intensified and weakened alternately thereby to remove the residual magnetism of the body portion without being influenced by the external magnetic field.

2 Claims, 4 Drawing Figures

DEMAGNETIZING APPARATUS FOR USE IN VEHICLES

BACKGROUND OF THE INVENTION

This invention relates to a demagnetizing apparatus for use in vehicles, in particular, automobiles for removing residual magnetism in a relevant part of the vehicle.

For removing magnetic field distortion in a bearing indicator due to residual magnetism in the vehicle where the bearing indicator is mounted, hitherto use has been made of externally mounted compensation magnets for making compensation to obtain a correct bearing indication.

In such a construction, various considerations such as the position of installation, number and magnetic field intensity of compensation magnets to be externally installed for cancelling the field distortion due to the residual magnetism in the vehicle are necessary and present various complications for effecting the compensation. In addition, different compensations are required with different vehicles since the field distortion characteristics varies with vehicles.

SUMMARY OF THE INVENTION

The invention is contemplated in the light of the above problems, and its object is to provide a demagnetizing apparatus for use in vehicles, which comprises a first coil for producing a direct current magnetic field to cancel the external magnetic field so as to produce an imaginary magnetism-free space or a space with substantially no magnetic field, and a second coil wound perpendicularly with respect to the first coil for producing an alternating current magnetic field in the imaginary magnetism-free space, whereby the magnetic field distortion due to residual magnetism in the relevant part of the vehicle can be removed without the possibility of mutual interference between the first and second coils.

DESCRIPTION OF THE PREFERRED EMBODIMENTS

Figure 1:
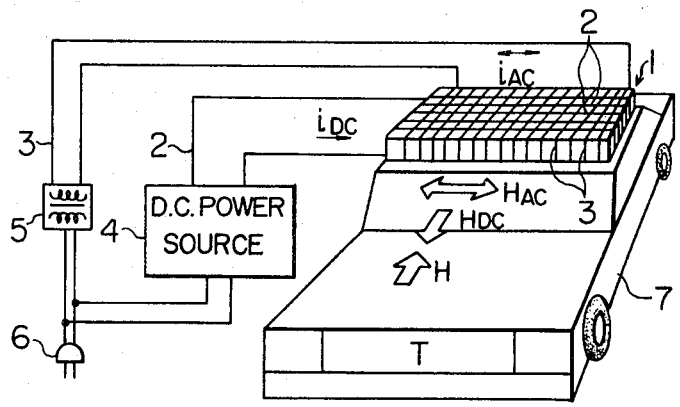
FIG. 1 shows a first embodiment of the demagnetizing apparatus according to the present invention.

Now, the invention will be described in conjunction with some preferred embodiments thereof with reference to the accompanying drawings. FIG. 1 schematically shows a demagnetizing apparatus according to the invention for demagnetizing the roof of a vehicle 7. Designated at 1 is a demagnetizer frame of a rectangular cubic shape, which has a suitable depth and has a length and a width corresponding to the roof of the vehicle 7 and the frame 1 is located adjacent to the roof for demagnetizing the entire roof thereof. The frame 1 is made of a non-magnetic material such as wood and plastics. A first coil, which is a direct current magnetic field coil 2, is wound around the demagnnetizer frame 1 e.g., widthwisely, and its ends are connected to a direct current power source 4 serving as a direct current generator so that a direct current magnetic field $H_{DC}$ of a desired field intensity can be obtained in the longitudinal direction through the frame 1 and hence through the roof. A second coil which is an alternating current magnetic field coil 3 is wound around the demagnetizer frame 1 such that the coil 3 is perpendicular to the direct current magnetic field coil 2, and its ends are connected to a transformer 5 as an alternating current generator so that an alternating current magnetic field $H_{AC}$ of a desired field intensity can be obtained in the widthwise direction through the frame 1 and hence through the roof. A power source plug 6 is for connection to a commercially available alternating current power source. In operating the demagnetizing apparatus, the direction thereof is so arranged that the direction of the $H_{DC}$ is opposite to the external magnetic field, that is, the terrestrial magnetism. The direct current magnetic field $H_{DC}$ that is set up by supplying a d-c current $i_{DC}$ through the direct current magnetic field coil 2 has an effect of cancelling the external magnetic field H, thus producing an imaginary magnetism-free space around and including the roof of the vehicle 7. That is, the direct current magnetic field $H_{DC}$ is produced to have a magnitude equal to the external magnetic field H and in opposite sense. In the state that the imaginary magnetism-free space is produced around the roof of the vehicle 7, the magnetic field distortion in the roof of the vehicle 7 is removed by controlling the alternating current magnetic field $H_{AC}$ to strengthen and to weaken with the control of the alternating current $i_{AC}$ caused through the alternating current magnetic field coil 3. In this case, the magnetic field distortion can be reliably removed since the alternating current magnetic field $H_{AC}$ is provided in the imaginary magnetism-free state. For cancelling the external magnetic field H due to the terrestrial magnetism or the like over the entire roof of the vehicle 7, it is necessary to produce a direct current magnetic field with a flux density of 0.2 to 0.4 gauss (being fixed for a given geographical region or locality), and for removing the magnetic field distortion over the entire roof of the vehicle 7 an alternating current magnetic field with a maximum flux density of 10 gauss is necessary. In this case, the alternating current magnetic field is intensified gradually from 0 to 10 gauss in flux density during a time period of about 30 seconds and the gradually reduced to 0 flux density in a time period of about 1 or 2 minutes. Thus, sufficient direct current and alternating current to obtain the flux densities of the afore-mentioned values are supplied to the respective direct current magnetic field coil 2 and alternating current magnetic field coil 3.

While the embodiment of FIG. 1 is described as to the demagnetization of the roof of the vehicle 7, the same method of demagnetization as described is of course applicable to other parts of the vehicle 7 such as a door and bonnet.

Figure 2:
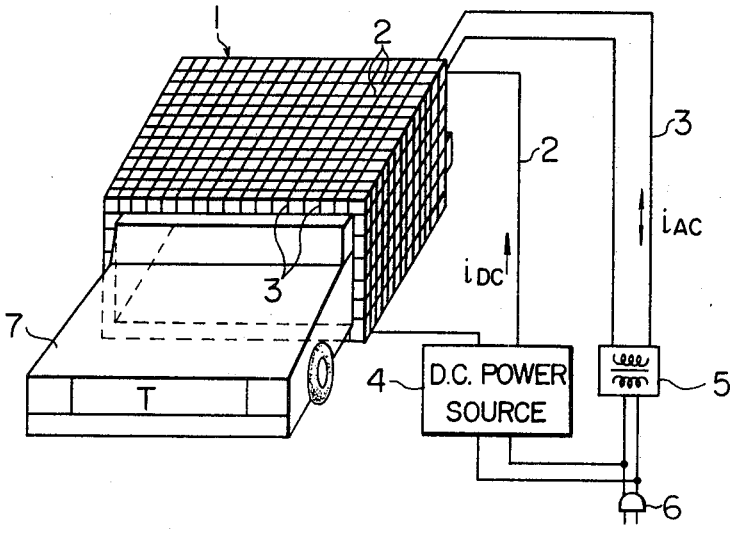
FIG. 2 shows a second embodiment of the invention.

FIG. 2 schematically shows a second embodiment of the demagnetizing apparatus which can demagnetize the roof, doors and floor of the vehicle 7 at the same time. A direct current magnetic field coil 2 and alternating current magnetic field coil 3 are again wound on a demagnetizer frame 1 such that they are perpendicular to each other. The demagnetizer frame 1 in this case is formed in a rectangular cylindrical shape and each side portion of the frame 1 corresponds to the frame 1 of FIG. 1. However the direct current magnetic field coil 2 is wound around the four sides of the frame 1. For providing the imaginary magnetism-free space round the roof, doors and floor of the vehicle 7, the demagnetizer frame 1 is disposed such that the various parts of the vehicle mentioned are at an equal distance from the inner side of the frame, whereby the magnetic field distortion in these parts can be simultaneously removed. The coil 2 may be wound around on each side portions of the frame 1 in the same way as in the case of FIG. 1.

Figure 3:
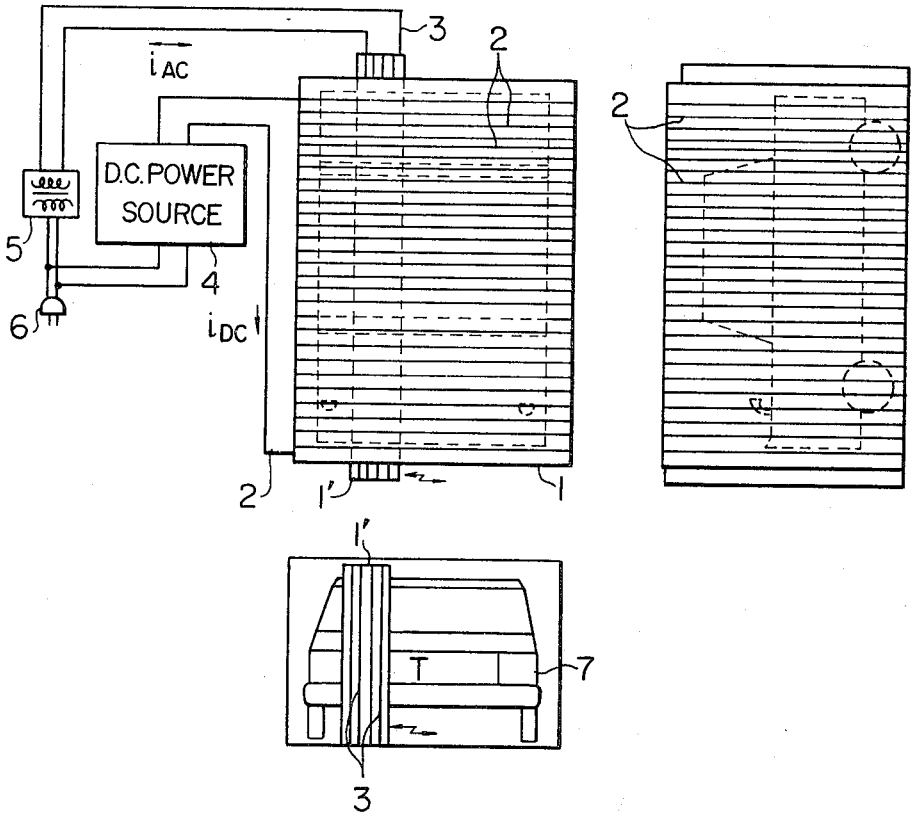
FIG. 3 shows a third embodiment of the invention.

FIG. 3 schematically shows a third embodiment of the demagnetizing apparatus which can demagnetize the whole vehicle 7. In this embodiment, the direct current magnetic field coil 2 is wound around four sides of a demagnetizer frame 1 which is assembled in a rectangular cylindrical shape to cover the whole vehicle 7 except the front and rear sides thereof, and the alternating current coil 3 is wound on a separate movable demagnetizer frame 1' such that it is perpendicular to the direct current magnetic field coil 2. The external magnetic field is cancelled by the direct current magnetic field coil 2 to produce the imaginary magnetism-free space for the whole vehicle 7, and the magnetic field distortion in the whole vehicle 7 can be removed by moving the demagnetizer frame 1' with alternating current supplied to the alternating current magnetic field coil 3.

Figure 4:
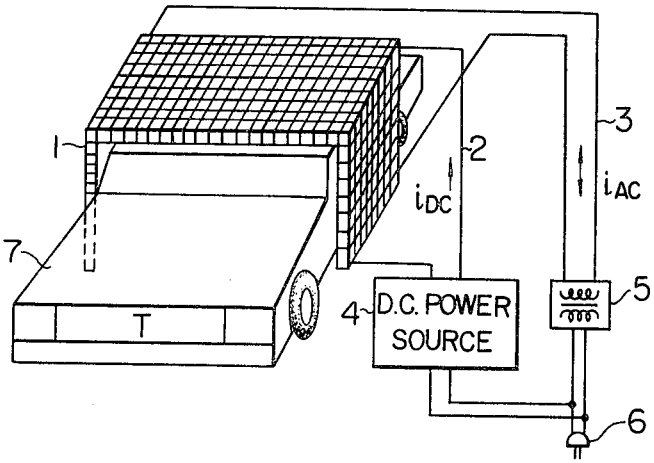
FIG. 4 shows a fourth embodiment of the invention.

FIG. 4 schematically shows a fourth embodiment of the demagnetizing apparatus which can simultaneously demagnetize the roof and doors of the vehicle 7. The demagnetizer frame 1 is similar to that of FIG. 2 with the exception that the floor side portion is lacking. The direct current magnetic field coil 2 and alternating current magnetic field coil 3 are wound around the demagnetizer frame 1 such that they are perpendicular to each other, and the magnetic field distortion in the roof and doors of the vehicle 7 can be simultaneously distorted. For each side portion of the frame 1, the coil 2 and the coil 3 are wound in the same was in the case of FIG. 1.

As has been described in the foregoing, according to the invention a first coil wound to produce a magnetic field in the relevant part of a vehicle, a second coil wound perpendicularly to the first coil, a direct current generator for supplying a direct current to the first coil and an alternating current generator for supplying an alternating current to the second coil are provided to set up a direct current magnetic field with the direct current supplied to the first coil and set up an alternating current magnetic field with the alternating current supplied to the second coil, whereby the relevant part of the vehicle is demagnetized by the alternating current magnetic field in the imaginary magnetism-free space produced by the direct current magnetic field. Thus, it is possible to remove the magnetic field distortion due to the residual magnetism in the relevant part of the vehicle without the possibility of the mutual interference between the first and second coils. In addition, where a bearing detection sensor is mounted in the vehicle, it is possible to detect precisely a bearing or direction of the vehicle in which the vehicle is moving without need of externally installing compensation magnets or without being substantially affected by the distortion due to magnetism induced by terrestrial magnetism and magnetic field distortion.

We claim:

1. A demagnetizing apparatus for removing residual magnetism in the body of an automobile comprising:
   - a first coil wound to produce a magnetic field in a relevant part of the body of said automobile;
   - a second coil wound perpendicularly with respect to said first coil for producing an orthogonal magnetic field in the relevant part of the body of said automobile;
   - direct current generating means for supplying direct current to said first coil to establish a direct current magnetic field opposite in direction to an extraneous magnetic field to cancel the same; and
   - alternating current generating means for supplying a controllable alternating current to said second coil to establish an alternating current magnetic field which is orthogonal to said direct current magnetic field, with the strength of the alternating current magnetic field being varied to increase and to decrease at a predetermined rate, whereby the residual magnetism of said relevant part of the body is demagnetized by said alternating current magnetic field in an imaginary extraneous magnetism-free space produced by said direct current magnetic field.

2. A demagnetizing apparatus for removing residual magnetism in the body of an automobile comprising:
   - A rectangular cubic frame substantially flat and made of a non-magnetic material, said frame being adapted to be positioned with one flat surface thereof adjacent to but spaced from the surface of the body of said automobile;
   - a first coil wound around said frame in parallel with a first axis of said frame;
   - a second coil wound around said frame in parallel with a second axis of said frame, said second axis being perpendicular to said first axis;
   - a d.c. power source for energizing said first coil to produce along the second axis a d.c. magnetic field in and around a portion of the body of said automobile, said d.c. magnetic field being of the magnitude and polarity to cancel the external magnetic field caused by the terrestial magnetism;
   - a controllable a.c. power source for energizing said second coil to produce an a.c. magnetic field along the first axis in and around said portion of the body of said automobile, said a.c. magnetic field being perpendicular to said d.c. magnetic field and being controlled to be intensified gradually from a minimum to a maximum magnitude and then weakened gradually from the maximum to the minimum magnitude.

* * * * *